United States Patent [19]

Fleming

[11] Patent Number: 4,550,873

[45] Date of Patent: Nov. 5, 1985

[54] FAST FOOD SERVING TRAY

[75] Inventor: James W. Fleming, Vancouver, Canada

[73] Assignee: Lawson & Jones Limited, Mississauga, Canada

[21] Appl. No.: 724,762

[22] Filed: Apr. 18, 1985

Related U.S. Application Data

[63] Continuation-in-part of Ser. No. 569,770, Jan. 10, 1984, Pat. No. 4,512,512.

[51] Int. Cl.[4] ..... B65D 5/36

[52] U.S. Cl. ..... 229/30; 229/15; 206/229; 206/563

[58] Field of Search ..... 229/30, 15; 206/557, 206/558, 562, 563

[56] References Cited

U.S. PATENT DOCUMENTS

| | | | |
|---|---|---|---|
| 1,811,478 | 6/1931 | Seckendorf | 229/30 |
| 2,875,940 | 3/1959 | Dunn | 229/30 |
| 3,499,595 | 3/1970 | Brooks | 229/30 |
| 3,722,781 | 3/1973 | Page et al. | 229/30 |
| 3,844,471 | 10/1974 | Hind | 229/30 |
| 4,219,144 | 8/1980 | Hagelberg | 229/30 |
| 4,278,197 | 7/1981 | Scheinbaum et al. | 206/563 |
| 4,512,512 | 4/1985 | Fleming | 206/563 |

*Primary Examiner*—Joseph Man-Fu Moy
*Attorney, Agent, or Firm*—Laubscher & Laubscher

[57] ABSTRACT

A fast food serving tray has the shape of a ship or boat. It is formed from a partly assembled, knocked down structure formed from an integral, single blank of cardboard or the like. The pre-assembled arrangement has the sides of the boat structure flat and co-planar with each other. The side walls are preferably adhesively secured to each other at each end of the tray. When the side walls are spread apart to form the rounded shape of a ship bowl, a folded bottom wall is brought into a planar relationship forming a reinforcement at the bottom edges of the side walls. Two generally circular openings are formed on top of the tray together with a relatively large rectangular central opening which is reinforced by a pair of inwardly turned rectangular panels, one at each side of the tray. The advance in the art is in an improved sturdiness and an ease of assembly.

22 Claims, 11 Drawing Figures

FAST FOOD SERVING TRAY

CROSS-REFERENCE TO RELATED APPLICATIONS

This is a continuation-in-part application of the commonly assigned, copending U.S. patent application, Ser. No. 569,770, filed Jan. 10, 1984, entitled "FAST FOOD SERVING TRAY", now U.S. Pat. No. 4,512,512.

BACKGROUND OF THE INVENTION

The present invention relates to the art of fast food serving trays and in particular to a fast food serving tray having the shape of a ship or a boat. The invention is also concerned with a cardboard blank from which the fast food serving tray can be made.

The fast food serving industry is a highly competitive field in which successful promotion may have a decisive role in the economic performance of the particular outlet. The design of fast food serving trays belong to important promotional items to be considered in this industry. In general terms, a fast food serving tray has to accommodate a container with a hamburger or the like, such container being usually made of a plastic material and being of a rectangular or square plan. Furthermore, a cup of soft drink and a cup of coffee, together with a package of French fries belong to the usual items served on one order.

Many attempts have been made to provide fast food serving trays made from a carton blank and having the shape of a ship or a boat. It is known that such shape is attractive to customers, particularly when its exposed sides and top are suitably provided with printed ornamentation.

Many design patents have been issued for such trays. Among these design patents, the following prior art references should be mentioned: U.S. Pat. No. Des. 199,205 issued Sept. 22, 1964 (Prestigiacomo); U.S. Pat. No. Des. 164,077 issued Jul. 24, 1951 to J. J. Wendell; U.S. Pat. No. Des. 88,269 issued Nov. 8, 1932 to E. E. Taylor, the last mentioned reference being concerned with a combined tray and receptacle for toilet preparations; U.S. Pat. No. Des. 24,452 issued Jul. 2, 1895 to E. Saalbach; and, finally, U.S. Pat. No. Des. 209,628 issued Dec. 19, 1967 to R. E. Burnsworth, relating to an egg carton.

In order to meet all practical requirements, a fast food serving tray has not only to be attractive in appearance but has also to have several other features to which belongs an easy storage before the use, relatively low production cost of the tray and an easy assembly for the serving purpose.

The attractiveness of the boat or ship-shaped serving tray has been proven. However, the known serving trays of this shape and produced from a cardboard blank suffer from the disadvantage of a very complex blank which requires a complex tooling for the production. Furthermore, the known fast food serving trays made from a foldable blank are relatively complex to assemble. Thus, the attractive appearance is achieved at the expense of high cost and difficult assembly of the tray into an operative state.

Many drawbacks of the above prior art have been overcome in a fast food serving tray of the present applicant, as described and claimed in my co-pending patent application, Ser. No. 569,770, filed Jan. 10, 1984, and entitled "FAST FOOD SERVING TRAY". I have now discovered that the sturdiness of the tray described in the above co-pending application can be significantly improved without impairing the ease and speed of bringing the respective blank from a generally flat state to a fully erected state ready for receiving the items of fast food to be served.

SUMMARY OF THE INVENTION

Accordingly, it is an object of the present invention to provide an improved fast food serving tray which would be relatively inexpensive to produce, which would be easy to store prior to use and which would be relatively easy and quick to assemble into the operative tray.

In accordance with one aspect of the present invention, a foldable blank is provided for forming a serving tray for fast food or the like, said blank including: a quadrangular central section having two opposed, generally parallel, longitudinal sides and two opposed end edges; a first bottom wall section connected to one of said sides of the central section by a first fold line generally coincident with the elongation of said one of said sides; a second bottom wall section connected to the other one of said sides of the central sections by a second fold line generally coincident with the elongation of the other one of said sides; said first bottom wall section being provided, at a normally inside surface thereof, with a first connecting strip disposed along and generally coincident with a free edge of the first bottom section remote from and generally parallel with said first fold line, said first connecting strip being separated from the rest of the first bottom wall section by a line of weakness generally parallel with said first fold line; said second bottom wall section being provided, at a normally outside surface thereof, with a second connecting strip disposed along a margin thereof remote from and generally parallel with said second fold line, said second connecting strip being remote from the second fold line and close to but spaced from a free edge thereof remote from and generally parallel with said second fold line, whereby a free, non-connecting strip is provided between the second connecting strip and the free edge of the second bottom panel remote from the second fold line; the distance of an outermost margin of the second connecting strip from the second fold line being generally equal to that between the said line of weakness and the first fold line; a connecting tab section extending along and coincident with each of said end edges generally the entire width of the central section, each tab section being comprised of two connecting tabs, one to each side of the central section, said tab sections being connected to the rest of the central section by an end line of weakness; a generally H-shaped cut having a bar section and two leg sections, said cut being disposed centrally of the central section and being so arranged that said bar section coincides with a longitudinal centreline of the central section and is generally parallel with said sides, while the two leg sections of the cut are generally parallel with each other and extend transversely of said centreline, said two leg sections being equidistantly spaced from the point of intersection of longitudinal and transverse centrelines of the central section, the ends of the leg sections being each equidistantly spaced a predetermined distance from the respective adjacent side of the central section, whereby a generally rectangular panel is formed at each side of the bar section; a pair of arcuate, generally parabolic line-of-weakness sections, one at each end of the central section, each of said parabolic line-of-weakness sections extending from the ends of one of the leg sections of the "H" and having arcuate side sections symmetrical with respect to the longitudinal centreline, and a peak section disposed near the respective end edge, said peak section being formed by a generally arcuate cut, said side sections including uncut but weakened subsections, whereby each arcuate line section and the associated leg section of said "H" form a generally parabolic panel narrowing in the direction away from a transverse centreline of the sheet; and a longitudinal straight line of weakness at each end of the central section, coincident with the longitudinal centreline of the central section and extending from the point of intersection of the respective leg section with the bar section to the adjacent end edge of the sheet.

In another aspect, the present invention provides a blank as described in the preceding paragraph, folded along the longitudinal centreline to form two generally identical side panels with the connecting tabs of each connecting tab section folded on themselves and secured to each other in a co-planar, laminated relationship; the bottom wall sections are secured to each other at the connecting strips, the bottom wall sections being disposed between said generally co-planar side panels whereby a knocked-down fast food serving tray is produced having a flat and generally rectangular configuration.

In accordance with a still further aspect of the present invention, a serving tray for fast food or the like is provided which comprises, in combination: a pair of generally upright, outwardly convexly curved side walls connected with each other at connection tabs integral with the respective side walls at end sections thereof; said side walls being further integral with a pair of transverse top walls, each top wall having a parabolic contour in plan, said top walls being disposed one at each end of the tray; each top wall having a generally circular cutout formed centrally thereof, said generally circular cutouts being of the size adapted to removably receive a frustoconical container such as a plastic coffee cup; said top walls having inside end edges defining two opposed ends of a generally rectangular central opening adapted to receive a rectangular container such as a hamburger or fish tray, the two remaining opposed sides of said central opening being formed by adjacent sections of the side walls; a bottom wall formed of two bottom wall sections secured to each other along a longitudinal line, each bottom wall section being integral with the adjacent side wall at a line of weakness extending along a lowermost edge of the respective side wall.

BRIEF DESCRIPTION OF THE DRAWINGS

The invention will now be described by way of a preferred embodiment with reference to the accompanying drawings in which.

DETAILED DESCRIPTION OF PREFERRED EMBODIMENT

Figure 1:
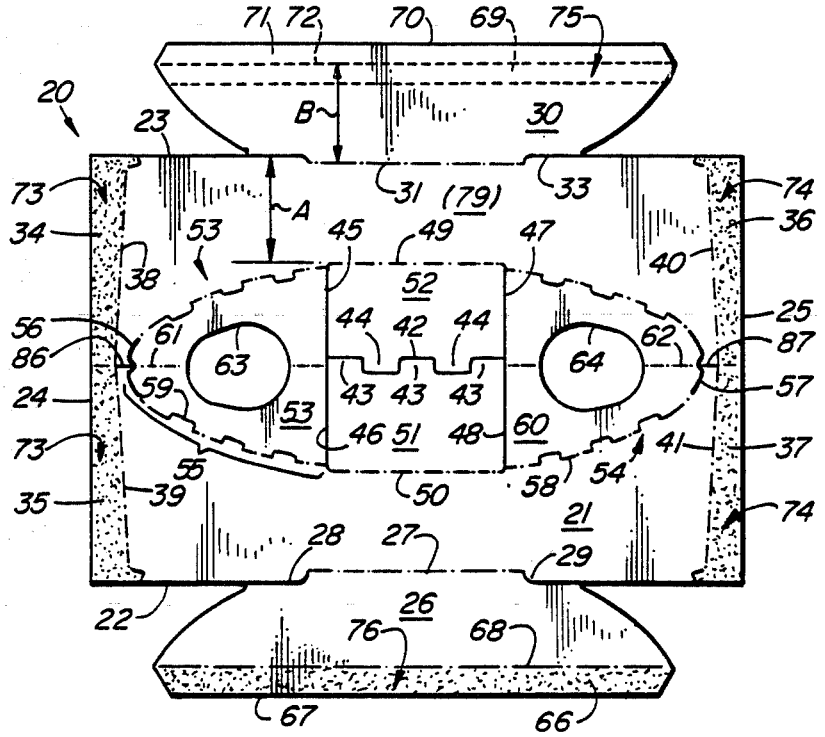
FIG. 1 is a reduced-scale view of an exemplary embodiment of an entirely unfolded cardboard blank from which the tray is produced.

Turning firstly to the arrangement of FIG. 1, the foldable blank 20 shown in this figure is formed of a rectangular central section 21 which has a first straight side 22, a second straight side 23, a first straight end edge 24 and a second straight end edge 25. In the preferred embodiment, the sides 22, 23 and the end edges 24, 25 define a rectangular structure. A first bottom wall section 26 is integral with the central section 21 at a first fold line 27, the ends of which merge, over J-shaped cuts 28, 29, with the first straight side 22. A second bottom wall section 30 is integral with the central section 21 at a second fold line 31, the ends of which merge, over J-shaped cuts 32, 33, with the second straight side 23.

The edge 24 coincides with and forms also an edge of a connecting tabs 34 and 35, while the end edge 25 is in a similar fashion coincident with a connecting tabs 36 and 37. The connecting tabs 34, 35 form what is referred to as a "connecting tab section" while the tabs 36 and 37 form another "connecting tab section". In the preferred embodiment each of the connecting tab sections extends the entire width of the central section 21 i.e. from the first side 22 to the second side 23. The connecting tab 34 is connected to the rest of the sheet by a line 38 of weakness. The tab 35 is similarly connected to the rest of the blank by a line 39 of weakness and similar lines 40, 41 of weakness connect the opposite connecting tabs 36, 37 to the central section 21.

In the embodiment shown in FIG. 1, the stipled lines denote lines of fold or lines of weakness. The full lines in FIG. 1 identify completely cut sections.

There is a generally H-shaped cut disposed centrally of the blank and including a bar section 42 formed by a wavy cut line producing tiny tabs 43 and 44. The left-hand leg section of the "H" is formed by a straight first cut 45 and straight second cut 46 which are aligned and which extend each to one side of the bar section 42. The bar section 42 is generally coincident with longitudinal centreline of the blank 20. The right-hand leg section of the "H" is formed by a third cut 47 and by a fourth cut 48 disposed one to each side of the bar section 42. It is apparent from FIG. 1 that in the shown embodiment the leg sections formed by cuts 45–48 are generally straight and parallel with each other and are also parallel with the end edges 25, 24.

It is also apparent that the leg sections formed by subsections 45–48 are equidistantly spaced from an imaginary centre of the blank 20 which is defined by the intersection of the longitudinal and transverse centrelines of the blank 20.

The outer end of the first cut 45 (which forms the upper end of the left leg) is spaced from the adjacent side 23 a distance A. Similarly, the free ends of each of the remaining legs 46, 47 and 48 are spaced from their adjacent edges 22, 23, by the same predetermined distance A. A line 49 of weakness extends between the free or outer ends of cuts 45, 47. A similar line 50 of weakness extends between the free or outer ends of cuts 46, 48. Thus, viewing FIG. 1, a rectangular panel 51 is defined below the bar section 42 of the "H". A similar panel 52 is formed above the bar section of the "H".

The free ends of the first cut 45 and of the second cut 46 coincide with an arcuate, generally parabolic line of weakness which is designated with reference numeral 53. A similar line of weakness is disposed to the other side of the blank of FIG. 1 and is referred to with reference numeral 54. Each of the parabolic lines of weakness 53, 54 is actually a system of combined cuts and lines of weakness as such. Therefore, it is correct to refer to each of the parabolic lines as being a "line of weakness sections". Each of these lines is formed by two arcuate side sections such as section 55. There are four sections such as section 55 and they are symmetrical with respect to the longitudinal and transverse centrelines of the blank 20. A peak section 56, 57 is disposed near the respective end edge 24, 25, respectively, and is formed by an arcuate cut. The remainder of each of the parabolic lines of weakness is formed by a combination of uncut but weakened subsections such as subsections 58 marked at the bottom right arcuate section, and intermediate cut subsections having generally the shape of a "U" and designated with reference numeral 59. Each parabolic line such as line 54 thus forms with its associated leg section of the "H" (formed by third and fourth cut 47, 48) a generally parabolic panel such as panel 60 which narrows or converges in the direction away from a transverse centreline of the blank. In other words, the panel 60 converges in a direction towards the adjacent end edge 25.

A longitudinal straight line of weakness 61, 62 at each end of the sheet coincides with the longitudinal centreline of the blank 20 and extends from the point of intersection of the respective leg section (e.g. leg section formed by the first cut 45 and second cut 46) with the bar section (in the shown example with the cut 42), to the adjacent end edge 24 of the blank. A generally circular cutout edge 63, 64 is disposed centrally of each of said generally parabolic panels 53 and 60. The "cutout edge" can be either of the type of a die-cut cutout as shown or, as an alternative, it can be merely a perforation line or a line of weakness arranged to allow the removal of the circular blank at the assemby stage. Accordingly, the term "cutout edge" is to be interpreted as being broad enough to cover both alternatives.

In a preferred embodiment, the length of each of the cuts 45, 46, 47 and 48 is generally equal to the distance A.

The tab sections formed by the connecting tabs 34, 35, 36 and 37 are provided with a coating 65 of a pressure sensitive adhesive on their surface facing the viewer of FIG. 1. The surface facing the viewer of FIG. 1 is also referred to as "a normally inside surface of the blank" as, on folding, all parts of that surface are at the inside of the tray.

It is also to be noted that in the preferred embodiment, the "U"-shaped cut subsections such as subsections 59, are so arranged that their concave openings are always directed outwardly of the respective parabolic panel 53 or 60.

The blank will normally be provided with suitable ornamental printing or with other suitable surface treatment at its normally outside surface as may be desired. If the cutout edges 63, 64 are die-cut as exactly circular lines of weakness (not shown in FIG. 1) thus leaving circular blanks as parts of the overall blanks, the circular blanks can be lithographed to display self-contained graphics such as a gold coin imitation, thus futher reducing the waste of cardboard material. Nevertheless, the clear, slightly ovoid cutouts shown in FIG. 1 are preferred.

The size shown in the drawing of FIG. 1 is a substantially reduced version of the blank 20. In actual size, the length of the end edges 24, 25 would be approximately 28 centimeters and the length of the central section 21 would amount to approximately 46 centimeters.

Reference will now be made to the bottom wall sections 26, 30. The first bottom wall section 26 is provided with a first adhesive strip 66 disposed on the normally inside surface (as referred to above) of the section 26. The strip extends along and is in a general coincidence with a free edge 67 of the first bottom wall section 26. The strip 66 is generally parallel with the first fold line 27. The first adhesive strip 66 is separated from the rest of the section 26 by a line 68 of weakness parallel with the first fold line 27.

The overall contour and size of the second bottom wall section 30 presents a mirror image of that of the section 26. The section 30 is provided with an adhesive strip 69 which is of a width similar to that of the strip 66. However, the strip 69 is provided at the normally outer surface of the blank and is inwardly spaced from the free edge 70 of the section 30. Thus, a glue-free marginal strip or tab 71 is provided between the second adhesive strip 69 and free edge 70.

The distance B between the outermost margin 72 of the second adhesive strip 69 from the second fold line 31 is equal to the distance between the line of weakness 68 and fold line 27.

A preferred way of an assembly of the shown blank will now be described. It is to be noted that the shown embodiment utilizes a pressure-sensitive adhesive and all connecting tabs and strips. The tabs 34, 35 are provided with layer 73, the tabs 36, 37 with layer 74 of a pressure adhesive and dried. The adhesive layer of the strip 69 is designated with 75 and that of the first adhesive strip 66 with reference numeral 76.

In a first step of assembling, both bottom wall sections 26, 30 are folded about the fold lines 27, 31 onto the normally inner surface of the central section 21 (facing the viewer of FIG. 1). The adhesive layer 75 now faces the viewer of FIG. 1, while the layer 76 is turned away from the viewer of FIG. 1. In the next step, the tab or strip 66 is folded about the line 68 of weakness such that the adhesive layer 75 now faces the viewer of FIG. 1. Next the central section 21 is folded about straight lines 61, 62 of weakness, i.e. about its longitudinal centreline to bring the normally inside surface parts of the central section 21 into contact with each other. This step results in the tabs 34–35 and 36–37 being in register with each other, the adhesive layer of each pair of the tabs being in contact with each other. Also, the strip 66 is now in register with the strip 69 so that the layers 76, 75 are in contact with each other.

Figure 8:
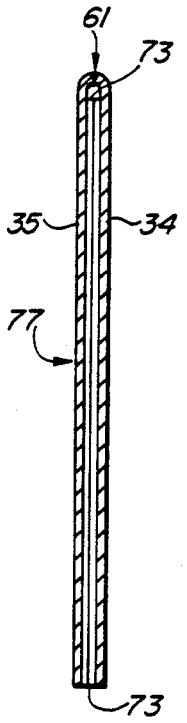
FIGS. 8–10 are sectional views VIII—VIII; IX—IX and X—X, respectively, of FIG. 7.
Figure 9:
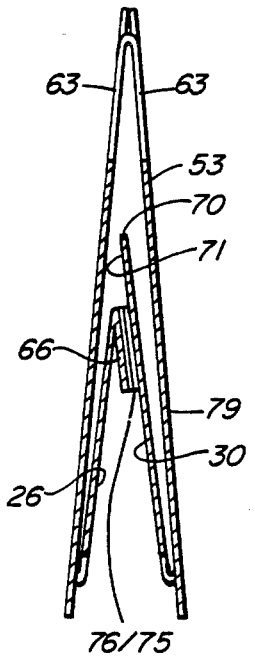
Figure 10:
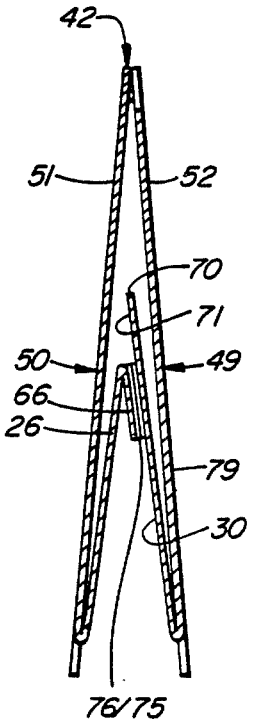
Figure 11:
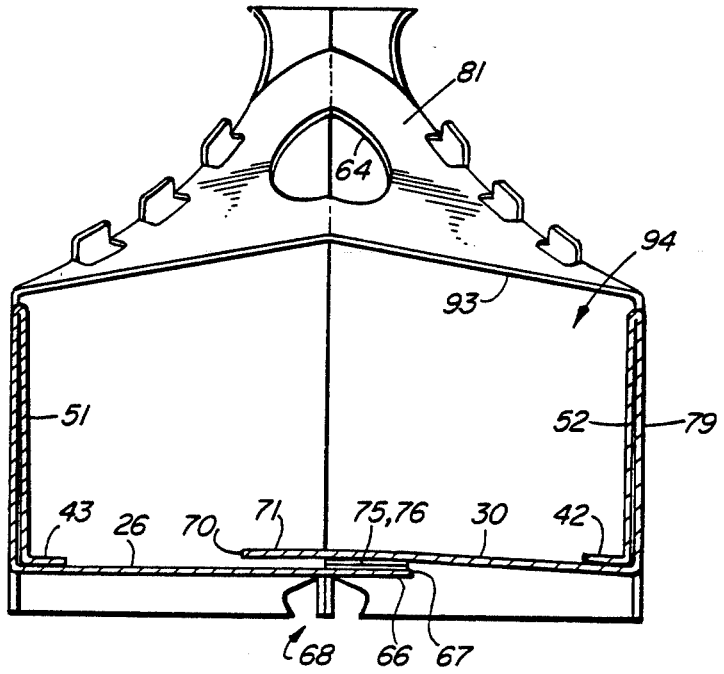
FIG. 11 is section XI—XI of FIG. 3, on enlarged scale.

On application of pressure, the tabs and strips 34–35; 36–37; 66–69 become adhesively secured to each other. Thus a knocked-down tray structure is formed which is shown in FIGS. 7 through 10. For the sake of clarity, the views of FIGS. 9 and 10 show the arrangement of the normally flat, knocked-down tray at the beginning of the unfolding of the tray into a fully open state. The flat configuration of FIG. 8 remains unchanged at such stage. The pre-folded and pre-assembled blanks (i.e. knocked-down trays) of FIGS. 7–10 are shipped to the users such as fast-food restaurants in a fully flattened state as shown in FIG. 8.

At this stage, the connecting tabs 34–35, 36–37 have formed laminated panels 77, 78 at each end of the tray. The bottom wall sections 26, 30 now form a bottom wall folded inwards between the sides of the tray, as best seen from FIGS. 9 and 10. The rectangular panels 51, 52 are each coplanar and co-extensive with the respective side wall.

When it is desired to fully erect the tray, the two sides of the tray are spread apart and the side panels 51, 52 folded inwardly over the respective sides. The tiny tabs 43 and 44 are deformed on engagement with the inside surface on the bottom wall sections (FIG. 2) and hold the bottom wall sections 26, 30 in a mutually coplanar arrangement with the result that the sides of the tray are deformed into a rounded shape resembling the hull of a boat.

Figure 2:
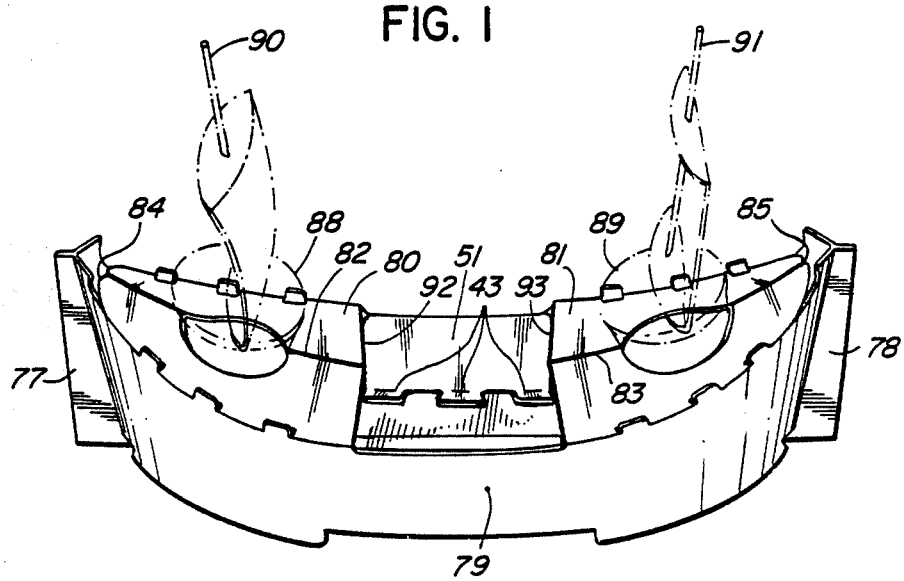
FIG. 2 is a perspective view of the tray in a fully assembled state.

The blank is now transformed to the shape of a tray having two generally upright, outwardly convexly curved sidewalls, of which only side wall 79 is designated in FIG. 2. The side walls are connected with each other at the end panels 77, 78 which correspond to the connection tabs 36–37 and 34–35, respectively. The bottom wall also connects the side walls to each other. Transverse top walls 80, 81 correspond to the parabolic panels 53, 60, respectively. A ridge 82, 83 centrally of each of the top walls 80, 81, respectively, correspond to the lines 61, 62 of weakness, respectively. The extreme ends of each of the top walls 80, 81 are formed by arcuate edges 84, 85 corresponding to the arcuate cuts 56, 57, respectively. The short longitudinal cuts 86, 87 at each end shown in FIG. 1 as extensions of the lines 61, 62, respectively, allow the end sections of the tray to form a generally V-shaped configuration as seen in FIG. 2 near the top of each of the end panels 77, 78.

Figure 3:
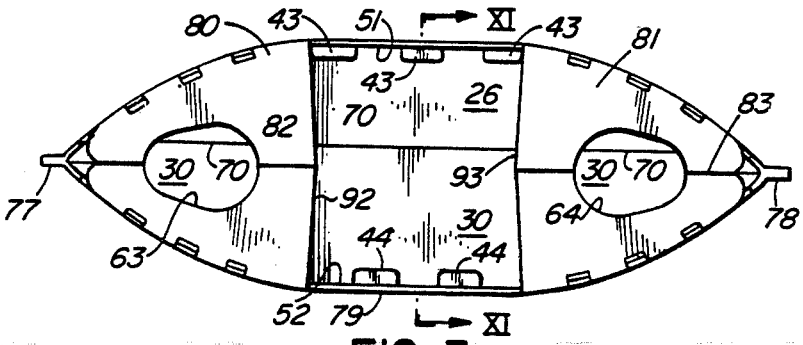
FIG. 3 is a top plan view of the tray of FIG. 2.
Figure 4:
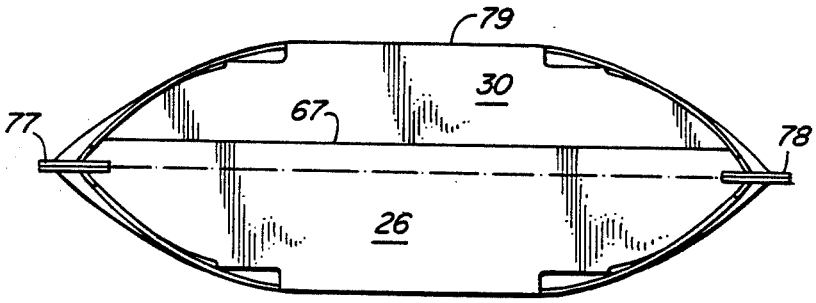
FIG. 4 is a bottom plan view of the tray of FIG. 2.

The cutouts at cutout edges 63, 64 are each of the size capable for receiving a container such as a frusto-conical plastic coffee cup 88 or a soft drink cup 89 of generally the same configuration and size. The cups 88, 89 can be provided each with a straw 90, 91 which, if desired, can each include a thin sheet resembling a sail. The top walls 80, 81 define inside end edges 92, 93 which correspond to the edges formed by cuts or legs 45–46 and 47–48, respectively. The two remaining opposed sides of a central opening 94 are formed by the inwardly turned rectangular panels 51, 52. Each panel 51, 52 thus forms a reinforcement of the respective side wall. The central opening 94 is of a rectangular configuration (see FIGS. 3 and 4) and is adapted to receive a normally rectangular serving tray holding a hamburger or the like.

Figure 5:
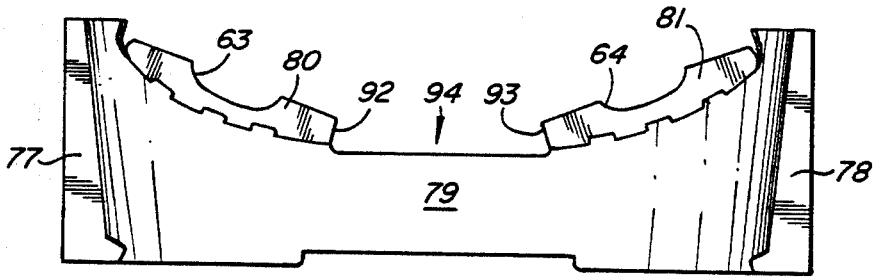
FIG. 5 is a side view of the tray of FIG. 2.
Figure 6:
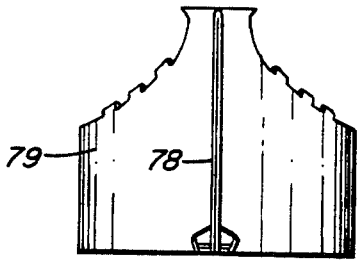
FIG. 6 is one end view thereof.
Figure 7:
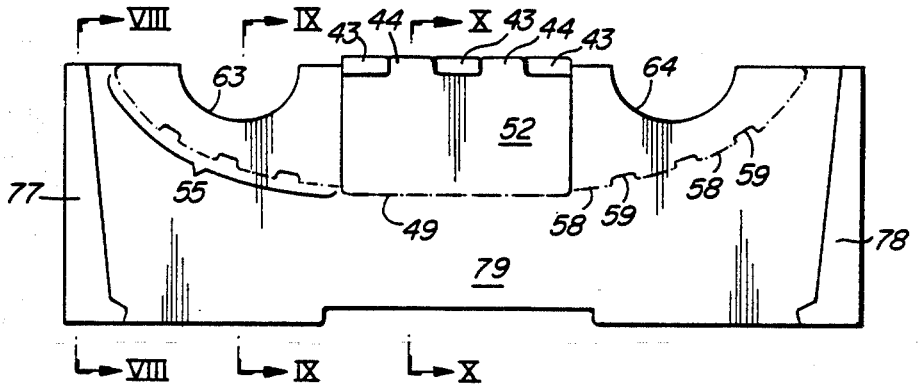
FIG. 7 is a side view showing the blank of FIG. 1 in an assembled but knock-down state.

The lines of weakness 53, 54, referred to in connection with the blank in FIG. 1 are now on the sides of the tray and form joined lines between each respective side wall, e.g. side wall 79 and the associated top wall 81. The "U"-shaped cut subsections 58 now form short, upwardly turned, small rectangular protrusions visible in FIG. 2 and also in FIGS. 5 and 6.

It will be appreciated from the above that the present invention provides a relatively inexpensive and sturdy fast food serving tray resembling the shape of a ship which can be easily assembled and is very economical from the standpoint of storage of the blanks prior to the assembly of the trays. The tray is easy to erect, particularly from a knocked-down arrangement.

Many modifications of the described embodiments exist which do not depart from the scope of the present invention as recited in the accompanying claims.

I claim:

1. A foldable blank for forming a serving tray for fast food or the like, said blank including:

(a) a quadrangular central section having two opposed, generally parallel, longitudinal sides and two opposed end edges;

(b) a first bottom wall section connected to one of said sides of the central section by a first fold line generally coincident with the elongation of said one of said sides;

(c) a second bottom wall section connected to the other one of said sides of the central sections by a second fold line generally coincident with the elongation of the other one of said sides;

(d) said first bottom wall section being provided, at a normally inside surface thereof, with a first connecting strip disposed along and generally coincident with a free edge of the first bottom section remote from and generally parallel with said first fold line, said first connecting strip being separated from the rest of the first bottom wall section by a line of weakness generally parallel with said first fold line;

(e) said second bottom wall section being provided, at a normally outside surface thereof, with a second connecting strip disposed along a margin thereof remote from and generally parallel with said second fold line, said second connecting strip being remote from the second fold line and close to but spaced from a free edge thereof remote from and generally parallel with said second fold line, whereby a free, non-connecting strip is provided between the second connecting strip and the free edge of the second bottom panel remote from the second fold line;

(f) the distance of an outermost margin of the second connecting strip from the second fold line being generally equal to that between the said line of weakness and the first fold line;

(g) a connecting tab section extending along and coincident with each of said end edges, generally the entire width of the central section, each tab section being comprised of two connecting tabs, one to each side of the central section, said tab sections being connected to the rest of the central section by an end line of weakness;

(h) a generally H-shaped cut having a bar section and two leg sections, said cut being disposed centrally of the central section and being so arranged that said bar section coincides with a longitudinal centreline of the central section and is generally parallel with said sides, while the two leg sections of the cut are generally parallel with each other and extend transversely of said centreline, said two leg sections being equidistantly spaced from the point of intersection of longitudinal and transverse centrelines of the central section, the ends of the leg sections being each equidistantly spaced a predetermined distance from the respective adjacent side of the central section, whereby a generally rectangular panel is formed at each side of the bar section;

(i) a pair of arcuate, generally parabolic line-of-weakness sections, one at each end of the central section, each of said parabolic line-of-weakness sections extending from the ends of one of the leg sections of the "H" and having arcuate side sections symmetrical with respect to the longitudinal centreline, and a peak section disposed near the respective end edge, said peak section being formed by a generally arcuate cut, said side sections including uncut but weakened subsections, whereby each arcuate line section and the associated leg section of said "H" form a generally parabolic panel narrowing in the direction away from a transverse centreline of the central section; and (j) a longitudinal straight line of weakness at each end of the central section, coincident with the longitudinal centreline of the central section and extending from the point of intersection of the respective leg section with the bar section to the adjacent end edge of the sheet.

2. A blank as claimed in claim 1, further comprising a generally circular cutout edge arranged to define the periphery of a cutout for a cup or the like, said cutout edge being disposed centrally of each of said generally parabolic panels.

3. A blank as claimed in claim 2, wherein said predetermined distance between the end of each of the leg sections and the adjacent side of the central section generally corresponds to the distance between the respective end of the associated leg section and the bar section of the cut.

4. A blank as claimed in claim 2, wherein the width of each connecting tab section decreases in the direction towards the longitudinal centreline of the sheet.

5. A blank as claimed in claim 2, wherein the connecting tab sections are provided with an adhesive coating at the normally inside surface of the blank.

6. A blank as claimed in claim 5, wherein the adhesive at the connecting tab sections and at said adhesive strips is a pressure-sensitive adhesive.

7. A blank as claimed in claim 2, wherein the side sections of the arcuate line sections are formed by alternating cut and weakened subsections.

8. A blank as claimed in claim 7, wherein the cut subsections are of a generally U-shaped configuration each open outwardly of the respective parabolic panel.

9. A blank as claimed in claim 1, further comprising a line of weakness generally parallel with the bar section and extending between free ends of the leg sections of the H-shaped cut.

10. A blank as claimed in claim 9, wherein each of said lines of weakness generally parallel with the bar section of the H-shaped cut is generally equidistantly spaced from the bar section and the adjacent side of the central section.

11. A blank as claimed in claim 1, wherein:

(a) the blank is folded along the longitudinal centreline to form two generally identical side panels with the connecting tabs of each connecting tab section folded on themselves and secured to each other in a co-planar, laminated relationship;

(b) the bottom wall sections are secured to each other at the connecting strips, the bottom wall sections being disposed between generally co-planar side panels;

whereby a knocked-down fast food serving tray is produced having a flat and generally rectangular configuration.

12. A blank as claimed in claim 11, wherein the connecting tab sections and the connecting strips are each secured to their respective counterpart by an adhesive.

13. A blank as claimed in claim 11, further comprising a line of weakness generally parallel with the sides of said rectangular configuration and extending between free ends of the leg sections of the H-shaped cut.

14. A blank as claimed in claim 13, wherein each of said lines of weakness generally parallel with the sides of the rectangular configuration is generally equidistantly spaced from both said sides.

15. A serving tray for fast food or the like, comprising, in combination, (a) a pair of generally upright, outwardly convexly curved side walls connected with each other at connection tabs integral with the respective side walls at end sections thereof;

(b) said side walls being further integral with a pair of transverse top walls, each top wall having a parabolic contour in plan, said top walls being disposed one at each end of the tray;

(c) each top wall having a generally circular cutout formed centrally thereof, said generally circular cutouts being of the size adapted to removably receive a frustoconical container such as a plastic coffee cup;

(d) said top walls having inside end edges defining two opposed ends of a generally rectangular central opening adapted to receive a rectangular container such as a hamburger or fish tray, the two remaining opposed sides of said central opening being formed by adjacent sections of the side walls;

(e) a bottom wall formed of two bottom wall sections secured to each other along a longitudinal line, each bottom wall section being integral with the adjacent side wall at a line of weakness extending along a lowermost edge of the respective side wall.

16. A serving tray as claimed in claim 15, wherein the width of each of said connection tabs increases in downward direction.

17. A serving tray as claimed in claim 15, wherein the connecting tabs at each end of the tray are adhesively secured to each other.

18. A serving tray as claimed in claim 15, wherein the connecting tabs at each end of the tray are adhesively secured to each other by a pressure sensitive adhesive.

19. A tray as claimed in claim 15, wherein the joinder between each side wall and the top walls is formed by alternating a cut and scored sections forming an arcuate joinder line.

20. A serving tray as claimed in claim 15, wherein said bottom wall sections are hinged relative to each other along a line of weakness coincident with longitudinal axis in one of the bottom wall sections.

21. A serving tray as claimed in claim 20, wherein the other bottom wall section forms a free end reinforcement tab section resting on an inside surface of the said one of the bottom wall sections, to maintain the bottom wall sections in a generally co-planar relationship when the bottom wall is subjected to a load acting at the inside of said central opening.

22. A serving tray as claimed in claim 15, wherein each of said adjacent sections of the side walls forming the opposed sides of the central opening is formed by a first part co-extensive with the respective curved side, and by a second part folded on said first part at the interior of the opening about a line of fold forming a top edge of the opening at each side thereof.

* * * * *